US006598498B1

(12) United States Patent
Pigford et al.

(10) Patent No.: US 6,598,498 B1
(45) Date of Patent: Jul. 29, 2003

(54) FASTENER EXTRACTOR

(75) Inventors: Robert B. Pigford, Portland, ME (US); David Shane Varney, Saco, ME (US); Mark T. Vogeler, New Gloucester, ME (US)

(73) Assignee: Irwin Industrial Tool Company, Rockford, IL (US)

( * ) Notice: Subject to any disclaimer, the term of this patent is extended or adjusted under 35 U.S.C. 154(b) by 0 days.

(21) Appl. No.: 10/051,351

(22) Filed: Jan. 18, 2002

(51) Int. Cl.[7] ..... B25B 13/48
(52) U.S. Cl. ..... 81/53.2; 81/441; 81/121.1
(58) Field of Search ..... 81/53.2, 441, 120, 81/121.1, 124.3, 124.6

(56) References Cited

U.S. PATENT DOCUMENTS

| | | | | |
|---|---|---|---|---|
| 1,590,200 A | * | 6/1926 | McGluckin | 81/121.1 |
| 3,161,090 A | | 12/1964 | McLellan | |
| 3,996,819 A | | 12/1976 | King | |
| 4,607,547 A | | 8/1986 | Martus | |
| 4,671,141 A | | 6/1987 | Hanson | |
| 4,781,082 A | * | 11/1988 | Swertz | 81/53.2 |
| 4,947,712 A | | 8/1990 | Brosnan | |
| 5,551,320 A | | 9/1996 | Horobec et al. | |
| 5,737,981 A | | 4/1998 | Hildebrand | |
| 5,931,064 A | * | 8/1999 | Gillespie | 81/121.1 |
| 6,003,411 A | | 12/1999 | Knox et al. | |
| 6,047,620 A | | 4/2000 | Kozak et al. | |
| 6,339,976 B1 | * | 1/2002 | Jordan | 81/53.2 |

OTHER PUBLICATIONS

Williams Advertisement, p. 4, Turbosocket Salvage Socket, May 2001.

* cited by examiner

*Primary Examiner*—D. S. Meislin
(74) *Attorney, Agent, or Firm*—Brinks Hofer Gilson & Lione

(57) ABSTRACT

A fastener extractor is provided that includes an attachment end having an attachment means for connection to an extraction tool and a receiving end. The receiving end has an interior bore that angles inwardly towards the attachment end. The interior bore has a central axis and includes at least two arcuate grooves that extend along the interior bore towards the attachment end. The arcuate grooves curve radially and inwardly towards the central axis of the interior bore, with adjacent arcuate grooves forming sharp helically shaped ridges. A transition area is positioned between the attachment end and the receiving end and has a plurality of arcuate surfaces. Each of the plurality of surfaces corresponds to each of the arcuate grooves and projects inwardly from the corresponding groove towards the central axis. The interior bore is engageable over a fastener to be extracted.

26 Claims, 6 Drawing Sheets

FASTENER EXTRACTOR

FIELD OF THE INVENTION

The present invention relates to tools for turning threaded fasteners such as bolts, nuts, studs, and the like, and more particularly relates to the use of wrench-type sockets for removing threaded fasteners that have heads that have been rounded off or otherwise damaged.

BACKGROUND

It is well known to use extraction tools to remove threaded fasteners that have been damaged. Typically, these tools are either used in conjunction with a socket wrench, or else a wrench may be placed around the periphery of the extraction tool in order to apply torque to remove the damaged fastener.

These tools often accomplish the extraction of a fastener through the use of "teeth" made up of angled faces located within an opening in the tool. To remove a fastener, the teeth partially cut into and grasp the fastener. These types of extraction tools, however, often have shortcomings in the geometry of the teeth. The shape of the teeth may cause material from various fasteners to build up between the teeth, thus rendering the tool less effective. This, in turn, may require cleaning the teeth, which may be tedious and time-consuming.

Another problem associated with the shape of the teeth is that when a fastener is being extracted, the fastener may penetrate and thus cause damage to the angled faces that make up the teeth. This may result in an extraction tool having a significantly shorter useful life.

Extraction tools typically are designed to be attached to a socket wrench on one end, and to be placed over a fastener at the other end. Thus, one end of the tool typically will have an opening that must be sized to be compatible with the socket wrench, while the other end will have an opening that is sized to be placed over a fastener to be removed. This opening may need to be sized to accommodate very large fasteners. When this occurs, the extraction tool may be more difficult to fabricate, since it may require a pair of openings to each be machined into the tool whose sizes vary greatly from each other.

Accordingly, it would be desirable to have an extraction tool that overcomes one or more of the disadvantages and limitations described above.

BRIEF SUMMARY

To alleviate the disadvantages of the prior art, a fastener extractor is provided herein. The fastener extractor includes an attachment end having an attachment means for connection to an extraction tool and a receiving end having an interior bore angles inwardly towards the attachment end. The interior bore has a central axis and includes at least two arcuate grooves that extend along the interior bore towards the attachment end. The arcuate grooves curve radially and inwardly towards the central axis of the interior bore with adjacent arcuate grooves forming sharp helically shaped ridges. A transition area is positioned between the attachment end and the receiving end and has a plurality of arcuate surfaces. Each of the plurality of surfaces corresponds to each of the arcuate grooves and projects inwardly from the corresponding groove towards the central axis.

In another embodiment of the invention, a socket wrench assembly is provided that includes a socket tool having an outwardly projecting male structure. A fastener extractor is also included and is configured for engagement over a fastener to be extracted. The fastener extractor has a receptacle that receives the male structure at a first end and has a frusto-conical receiving area at a second end. The receiving area has a central axis and extends inwardly and angularly towards the first end. At least two arcuate grooves extend along an inner surface of the receiving area towards the first end. The arcuate grooves curve radially and inwardly towards the central axis and towards the second end, with adjacent arcuate grooves forming sharp helically shaped ridges. A transition area is positioned between the receptacle and the receiving area and has a plurality of arcuate surfaces. Each of the plurality of surfaces corresponds to each of the arcuate grooves and projects inwardly from the corresponding groove towards the central axis.

Another embodiment of the invention includes a fastener extractor with an attachment end having a square-shaped receptacle for connection to a socket wrench. There is a receiving end that has an interior bore that angles inwardly at four degrees to a transition area. The interior bore has a central axis and includes six arcuate grooves that extend along the interior bore to the transition area. The arcuate grooves curve radially and inwardly towards the central axis of the interior bore, with adjacent arcuate grooves forming sharp helically shaped ridges. The transition area is positioned between the attachment end and the receiving end and includes six arcuate surfaces. Each of the surfaces corresponds to an arcuate groove and projects inwardly from the corresponding groove towards the central axis.

The invention provides a fastener extractor that is configured for engagement over a fastener to be extracted and allows for the convenient removal of damaged fasteners. The fastener extractor may be utilized with generally available tools to impart a large gripping and disengaging torque, including in areas that are difficult to access. The foregoing and other features and advantages of the invention will become further apparent from the following detailed description of the presently preferred embodiments, read in conjunction with the accompanying drawings.

DETAILED DESCRIPTION OF THE PREFERRED EMBODIMENTS

Figure 1:
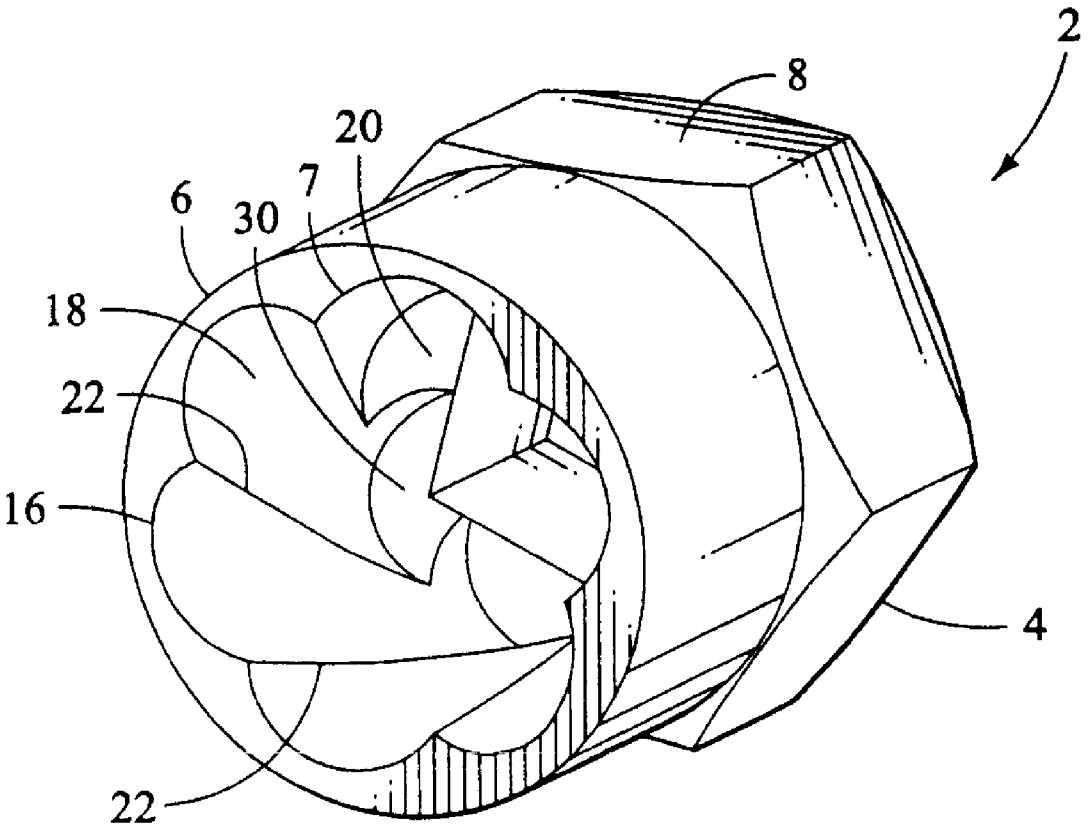
FIG. 1 is a perspective view of an embodiment of the present invention.

An embodiment of a fastener extractor 2 for removing threaded fasteners that have been damaged is shown in FIG. 1. The fastener extractor preferably is made of 4150 hardened steel, although in alternate embodiments other hardenable steels may be used that have a hardness in the range approximately 50 to 60 Rockwell C. In additional embodiments, moreover, powdered metals may also be used to make the fastener extractor.

Figure 2:
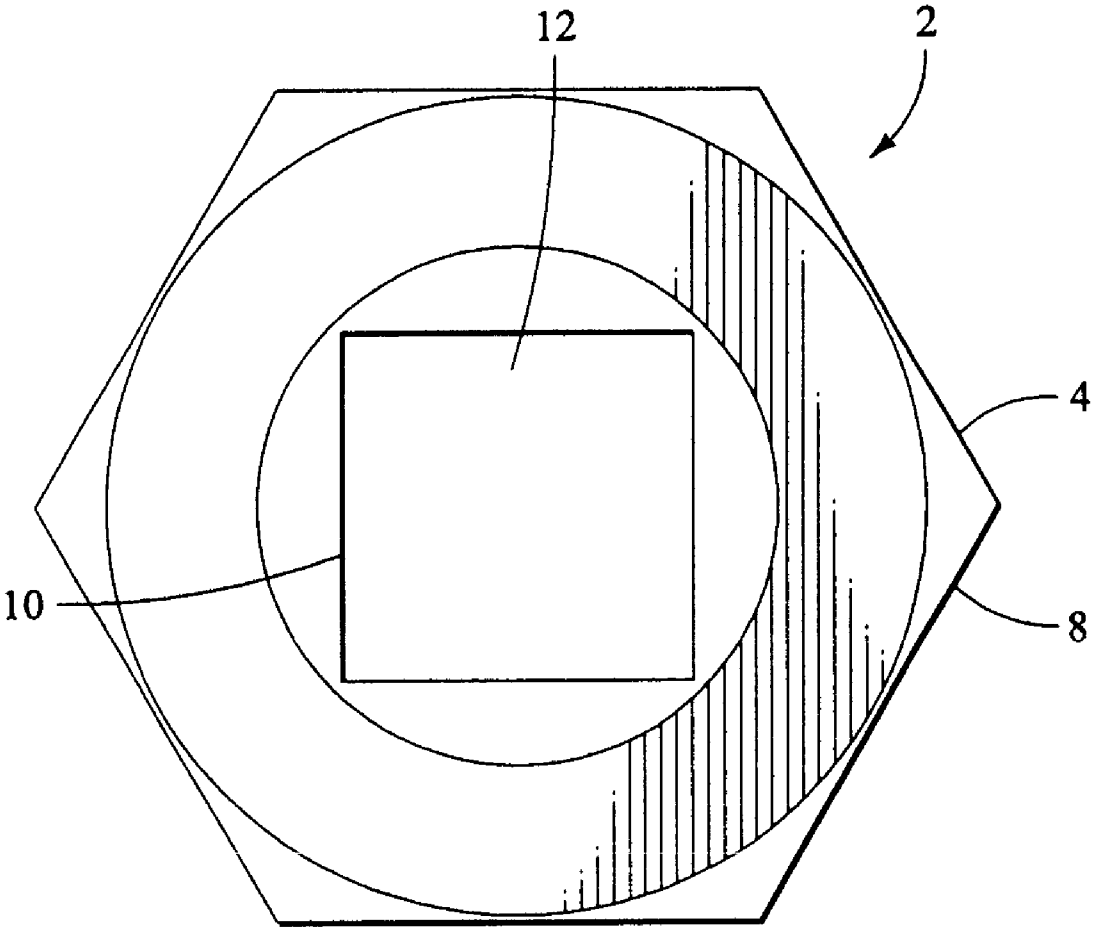
FIG. 2 is a rear plan view of the embodiment of FIG. 1.
Figure 3:
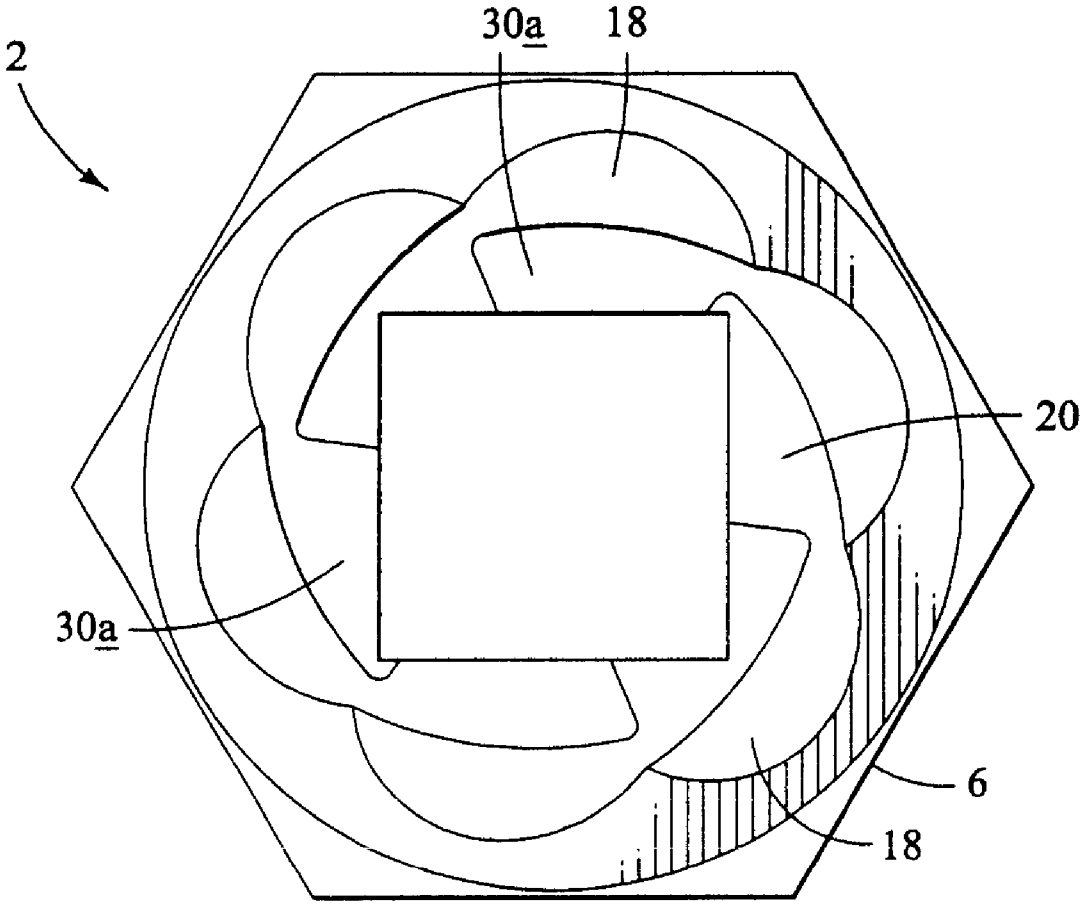
FIG. 3 is a front plan view of the embodiment of FIG. 1.
Figure 4:
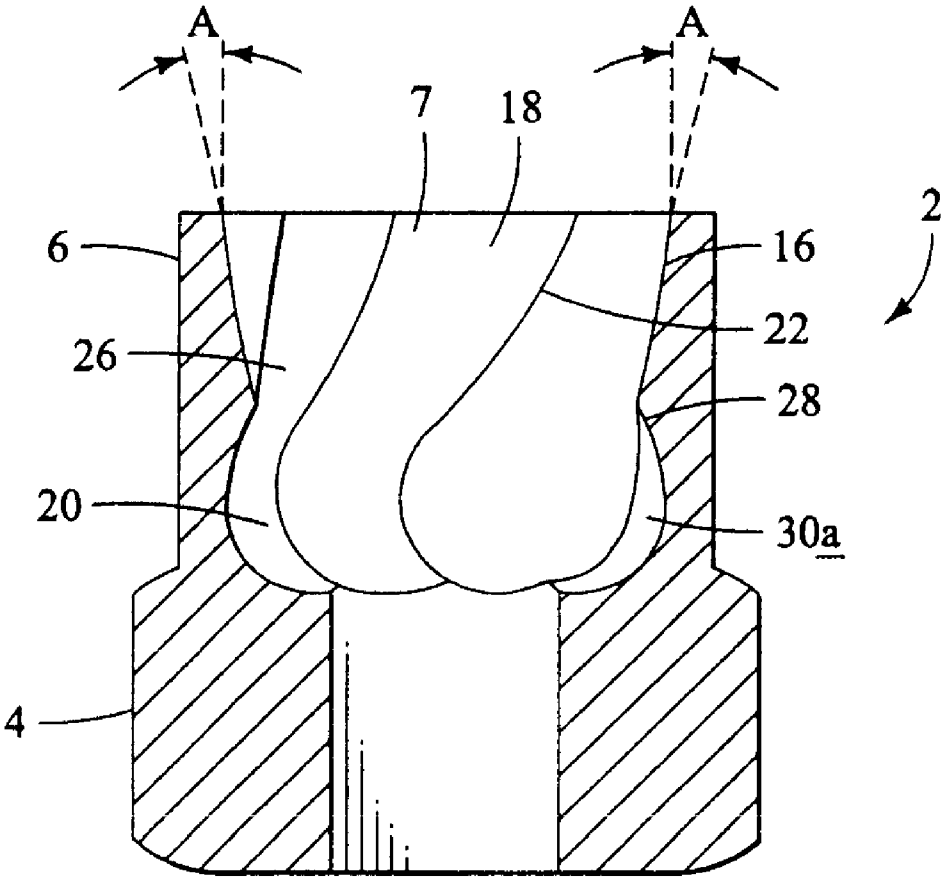
FIG. 4 is a vertical cross-sectional view of the embodiment of FIG. 1.

The fastener extractor 2 includes an attachment end 4 and a receiving end 6. Referring also to FIG. 2, in a preferred embodiment the attachment end 4 includes a hexagonally shaped outer surface 8 to facilitate the use of an open wrench (not shown) to apply a greater torque to the fastener extractor 2 and to utilize the fastener extractor 2 in tight spaces. Although the outer surface 8 is hexagonally shaped, those skilled in the art will readily understand that the outer surface can be otherwise shaped in order to be is used with a variety of tools. The attachment end 4 also includes an attachment means 10 for attachment to an extraction tool. In a preferred embodiment, the attachment means is a generally square receptacle 12 for receiving a conventional socket wrench square male attachment member. Typically, these socket wrench attachment members are sized in either ½-inch or ⅜-inch sizes. The receptacle 12 extends inwardly to a transition area 20 (FIGS. 1, 3, & 4). In alternate embodiments, and in order to be adaptable with a variety of extraction tools, the attachment means 10 may be otherwise shaped, and may also be a male structure rather than a receptacle.

The receiving end 6 preferably has a generally cylindrical outer shape and includes an interior bore 16 defined inwardly from a receiving opening 7. The bore 16 has a plurality of helically-shaped arranged grooves 18, each having arcuate cross-sections. The grooves 18 extend from the receiving end 6 towards the transition area 20 and curve radially and inwardly towards the central axis of the bore 16. In a preferred embodiment there are six grooves 18, so as to fit over a hexagonally shaped fastener head such as, by way of example, a nut. In additional embodiments, as those skilled in the art will recognize, there may be a different number of grooves, with additional embodiments having at least two grooves. Adjacent grooves 18 form sharp ridges 22 that extend in a helical fashion inside the bore 16. As will be discussed in more detail below, when the fastener extractor 2 is placed over a fastener head, the ridges "bite" into the material of the fastener.

The bore 16 and the grooves 18 define a generally frusto-conical receiving area 26. Looking into the bore 16 from the receiving end 6, the receiving area 26 angles inwardly towards the transition area 20. This angle, known as a draft angle and depicted as A in FIGS. 4 & 6, preferably is about 4 degrees, and thus causes the diameter of the receiving area 26 to decrease as it approaches the transition area 20. In other embodiments, however, the draft angle A may be in the range of from about 1 to 8 degrees inclusive. The draft angle A allows the fastener extractor 2 to more efficiently "grip" a damaged fastener without incurring slippage.

The transition area 20 is located at an inner end 28 of the bore 16 and provides a transition between the receiving end 6 and the attachment end 4. Preferably, the transition area is composed of smooth, radiused, arcuate surfaces 30*a*. There is one radiused surface 30*a* for each groove 18 that smoothly continues from the corresponding groove. Preferably, the radiused surface is formed using a ball end mill, although any suitable process may be used that results in a transition area having a smooth surface.

Figure 5:
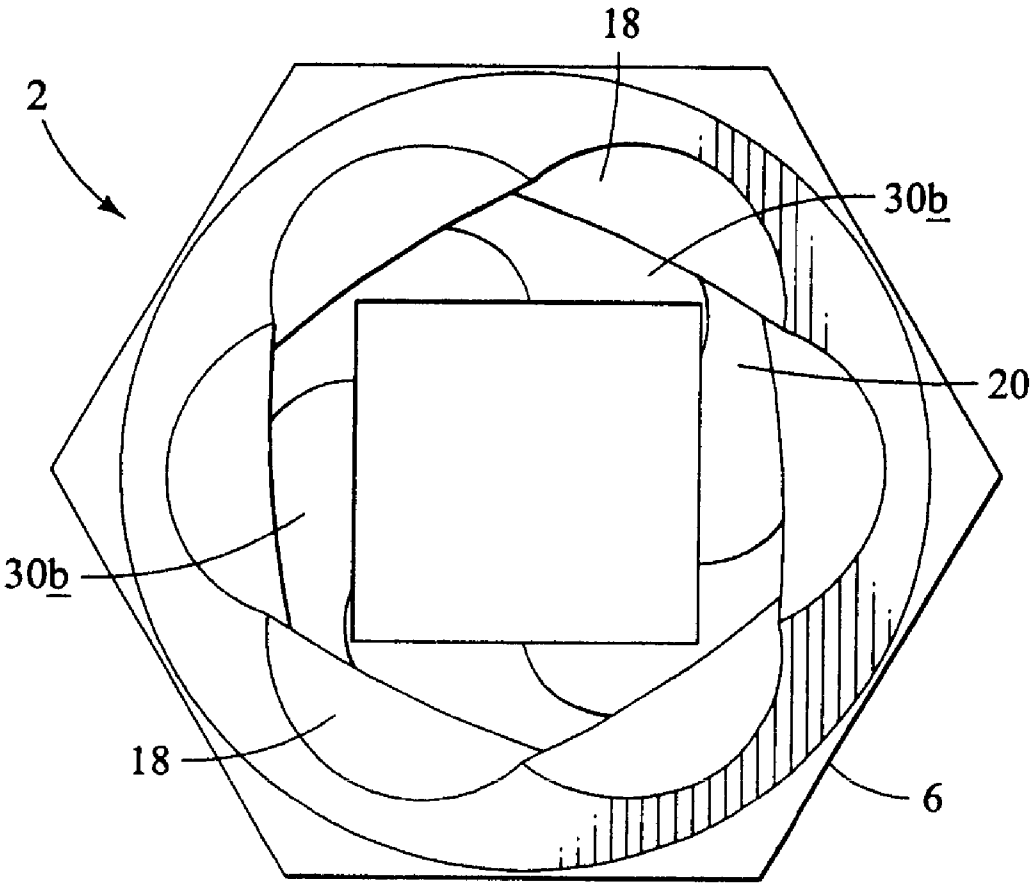
FIG. 5 is a front plan view of an alternate embodiment of FIG. 1 showing a transition area having angular, arcuate surfaces.
Figure 6:
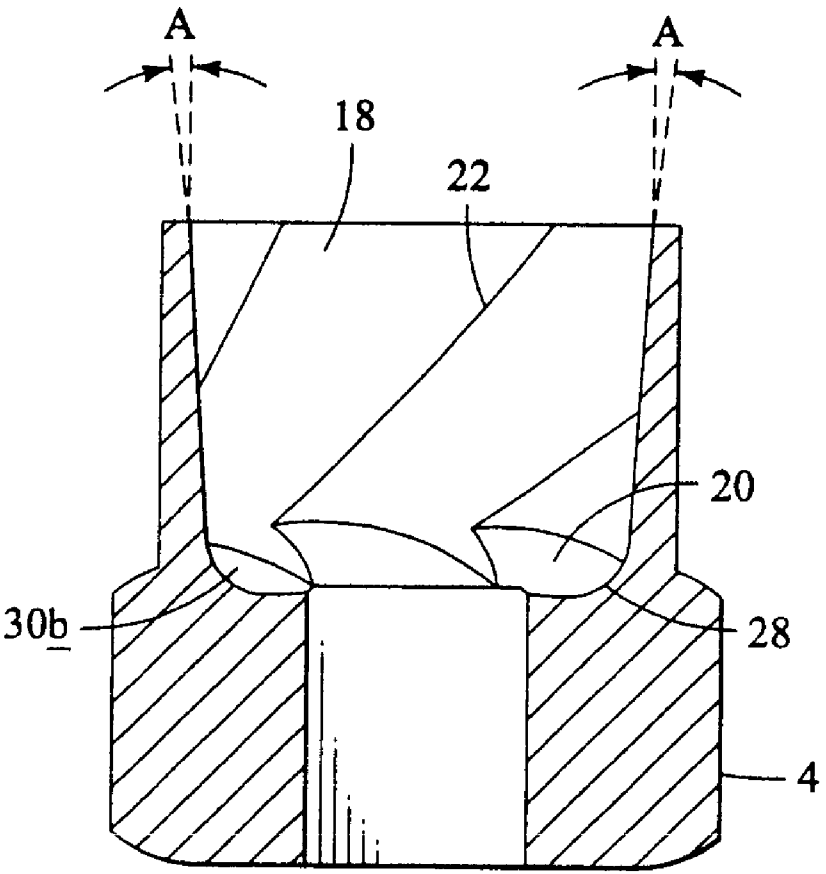
FIG. 6 is a vertical cross-sectional view of the embodiment of FIG. 5.

In other embodiments, and so that a variety of fabrication techniques may be used, the transition area may be composed of other than smooth radiused surfaces. By way of example, as shown in FIGS. 5 and 6, the transition area 20 may be composed of a plurality of arcuate surfaces 30*b* that are each angular, with one surface 30*b* corresponding to one arcuate groove 18.

Regardless of the type of surface associated with the transition area, each surface projects inwardly and downwardly from a corresponding groove. Although each surface preferably is generally perpendicular to the longitudinal axis of each groove, in other embodiments the surfaces may be otherwise angled.

Operation of the fastener extractor is as follows and is given with reference to a fastener having a right-hand thread. Those skilled in the art, however, will readily recognize the fastener extractor may be used to extract fasteners having left-hand threads by merely reversing the orientation of the grooves and ridges in the bore. In the illustrated device, the grooves are oriented so that a point moving along a groove from the transition area towards the receiving end appears to be moving in a clockwise direction when viewed through the receiving opening 7. This orientation is generally comparable to that of a left-hand thread. Thus, when the fastener extractor is used to extract a right-hand thread, rotation of the fastener extractor relative to the fastener during loosening will cause the ridges to bite into the fastener. Further rotation will cause the fastener extractor to be seated more firmly upon the fastener due to the decreasing diameter of the receiving area.

Once a fastener is extracted and is no longer in contact with the fastener extractor, the arcuate shape of the grooves and surfaces prevent large amounts of fastener material from remaining within the bore. There are no sharp crevices or creases for fastener material to get caught. Although a surface finish is not required, the surface finish of the bore preferably is made of an R16 surface finish in order to provide a smooth surface to further prevent material build up. In alternate embodiments, moreover, other suitable finishes that provide for smoothness of the bore may also be used.

The advantages of the above-described fastener extractor are numerous. The transition area, for example, allows a fastener extractor to have an attachment end whose size may be widely varied with respect to the size of the receiving end. This results in a fastener extractor that may be more easily fabricated via casting, machining the grooves into the bore, or any other suitable fabrication technique. The arcuate shape of the grooves and surfaces in the transition area allow for the fastener extractor to be generally self-cleaning, and also provides for limited penetration into the grooves when a fastener is being penetrated by the ridges, thus resulting in less wear on the bore. If so desired, the fastener extractor may also be used to engage securely threaded fasteners, albeit with some defacing of the fastener gripped by the fastener extractor.

Thus it can be seen that the present fastener extractor provides a simple and highly effective device for applying torque to extract a fastener that has a head that has been rounded off or otherwise damaged. The fastener extractor may be utilized with generally available tools to impart a large gripping and disengaging torque, including in areas that are difficult to access. As will be readily appreciated, the fastener extractor may be machined to various sizes in order to be used with a wide range of fasteners. While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A fastener extractor comprising:

an attachment end having an attachment means for connection to an extraction tool;

a receiving end having an interior bore that angles inwardly towards said attachment end, said interior bore having a central axis and including at least two arcuate grooves that extend along said interior bore towards said attachment end, said arcuate grooves curving radially and inwardly towards said central axis of said interior bore, whereby adjacent ones of said arcuate grooves form sharp helically shaped ridges;

a transition area positioned between said attachment end and said receiving end, said transition area having a plurality of arcuate surfaces, each of said plurality of surfaces corresponding to a respective one of said arcuate grooves and projecting inwardly from said corresponding groove towards said central axis;

whereby said interior bore is engageable over a fastener to be extracted.

2. The fastener extractor of claim 1, wherein said arcuate surfaces are smooth, radiused surfaces.

3. The fastener extractor of claim 1, wherein said arcuate surfaces are angular.

4. The fastener extractor of claim 1, wherein said attachment end further comprises a polygonally shaped outer surface.

5. The fastener extractor of claim 4, wherein said outer surface is hexagonally shaped.

6. The fastener extractor of claim 1, wherein said attachment means is a receptacle.

7. The fastener extractor of claim 6, wherein said attachment means is square shaped.

8. The fastener extractor of claim 1, wherein said attachment means is a male attachment structure.

9. The fastener extractor of claim 1, wherein said interior bore and said plurality of grooves define a generally frusto-conical receiving area that angles inwardly between about one and eight degrees inclusive to said transition area.

10. The fastener extractor of claim 9, wherein said frusto-conical receiving area angles inwardly at four degrees.

11. The fastener extractor of claim 9, wherein said interior bore has six arcuate grooves.

12. The fastener extractor of claim 1, wherein each of said plurality of surfaces of said transition area is generally perpendicular to a longitudinal axis of each of said grooves.

13. A socket wrench assembly, comprising:

a socket tool having an outwardly projecting male structure;

a fastener extractor having a receptacle that receives said male structure of said socket tool at a first end, and having a frusto-conical receiving area at a second end that extends inwardly and angularly towards said first end, said receiving area having a central axis;

at least two arcuate grooves that extend along an inner surface of said receiving area towards said first end, said arcuate grooves curving radially and inwardly towards said central axis and towards said second end, whereby adjacent ones of said arcuate grooves form sharp helically shaped ridges;

a transition area positioned between said receptacle and said receiving area, said transition area having a plurality of arcuate surfaces, each of said plurality of surfaces corresponding to a respective one of said arcuate grooves and projecting inwardly from said corresponding groove towards said central axis;

whereby said fastener extractor is configured for engagement over a fastener to be extracted.

14. The socket wrench assembly of claim 13, wherein said arcuate surfaces are smooth, radiused surfaces.

15. The socket wrench assembly of claim 13, wherein said arcuate surfaces are angular.

16. The socket wrench assembly of claim 13, wherein said receptacle is square shaped.

17. The socket wrench assembly of claim 13, wherein said frusto-conical receiving area angles inwardly at between about one and eight degrees inclusive to said transition area.

18. The socket wrench assembly of claim 17, wherein said frusto-conical receiving area angles inwardly at four degrees.

19. The socket wrench assembly of claim 13, wherein said frusto-conical receiving area has six arcuate grooves.

20. The socket wrench assembly of claim 13, wherein each of said plurality of surfaces of said transition area is generally perpendicular to a longitudinal axis of each of said grooves.

21. A fastener extractor comprising:

an attachment end having a square-shaped receptacle for connection to a socket wrench;

a receiving end having an interior bore that angles inwardly at four degrees to a transition area, said interior bore having a central axis and including six arcuate grooves that extend along said interior bore to said transition area, said arcuate grooves curving radially and inwardly towards said central axis of said interior bore, with adjacent ones of said arcuate grooves forming sharp helically shaped ridges, and wherein said transition area is positioned between said attachment end and said receiving end, said transition area having six arcuate surfaces, with each of said surfaces corresponding to a respective one of said arcuate grooves and projecting inwardly from said corresponding groove towards said central axis;

whereby said interior bore is engageable over a fastener to be extracted.

22. The fastener extractor of claim 21, wherein said attachment end further comprises a polygonally shaped outer surface.

23. The fastener extractor of claim 22, wherein said outer surface is hexagonally shaped.

24. The fastener extractor of claim 21, wherein said arcuate surfaces are smooth, radiused surfaces.

25. The fastener extractor of claims 21, wherein said arcuate surfaces are angular.

26. The fastener extractor of claim 21, wherein each of said surfaces of said transition area is generally perpendicular to a longitudinal axis of each of said grooves.

* * * * *